United States Patent [19]

Girard

[11] 4,044,478

[45] Aug. 30, 1977

[54] QUICK RELEASE FOR WADERS

[76] Inventor: Gerald H. Girard, Springside-Morrison Ave., Troy, N.Y. 12180

[21] Appl. No.: 665,221

[22] Filed: Mar. 9, 1976

[51] Int. Cl.[2] ..... A43B 3/00; A44B 9/00

[52] U.S. Cl. ..... 36/1.5; 24/162

[58] Field of Search ..... 36/1.5, 83, 138, 7.1, 36/7.3; 2/22, 23; 24/73 MC, 73 SC, 162, 150 R, DIG. 33

[56] References Cited

U.S. PATENT DOCUMENTS

| | | | |
|---|---|---|---|
| 2,230,291 | 2/1941 | Evans | 36/7.3 |
| 2,473,099 | 6/1949 | Hatch | 36/1.5 |
| 3,147,491 | 9/1964 | Fisch | 36/2 R |
| 3,331,083 | 7/1967 | Holly | 2/22 |

*Primary Examiner*—Patrick D. Lawson

*Attorney, Agent, or Firm*—Stephen Wyden

[57] ABSTRACT

Waders straps are attached to the waders by means of a male ferrule forming a shaftway fitting in a female ferrule forming a pair of shaftways and a pin attached to a strap is removably insertable through the shaftways securing the male and female ferrules together and thereby releasably securing the waders to a fisherman.

3 Claims, 3 Drawing Figures

QUICK RELEASE FOR WADERS

I have invented a new and novel quick release for waders. My device will quickly safely prevent a fisherman from being drowned by being pulled under the water if his waders should fill with water. In the prior art various devices have been provided to secure waders to a fisherman. The problem occurs in accidents when once the waders have filled with water it is impossible to release the waders because of the pressures on the waders due to the water. My waders can be released even while filled with water and while pulling the fisherman under, thus my waders can prevent drownings accidentally of fisherman.

My invention can be understood in view of the accompanying figures.

Figure 1:
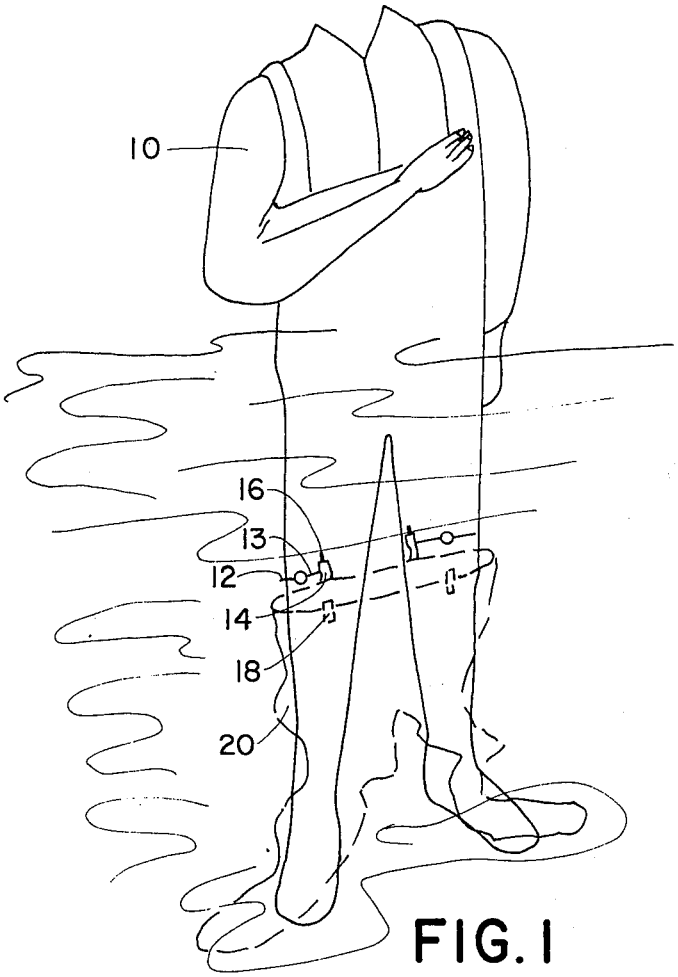
FIG. 1 shows a fisherman who has just released a pair of waders which are settled on the water around his feet.

In FIG. 1 a fisherman 10 has released a pin 12 connected by a chain 13 to a strap 14. A male ferrule 16 has thereby been released from a female ferrule 18 permitting the waders 20 to drop to the feet of the fisherman 10.

Figure 2:
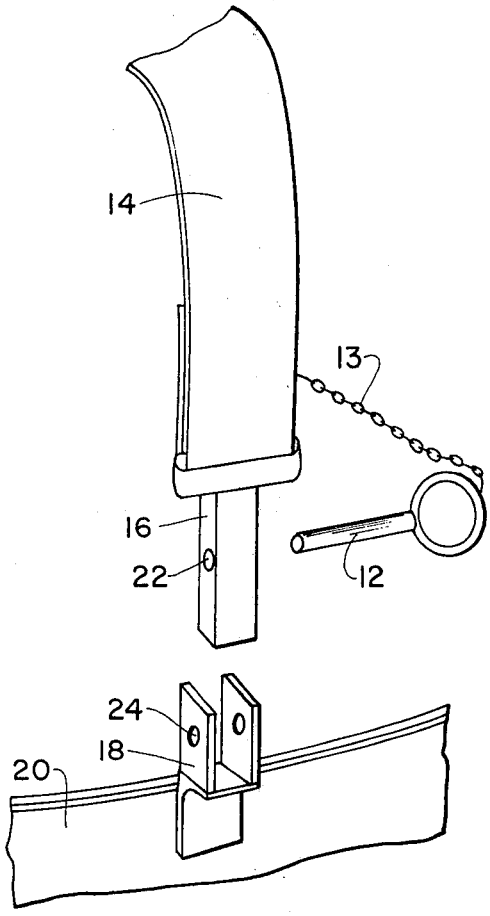
FIG. 2 is a close up in exploded view of the quick release for the waders.
Figure 3:
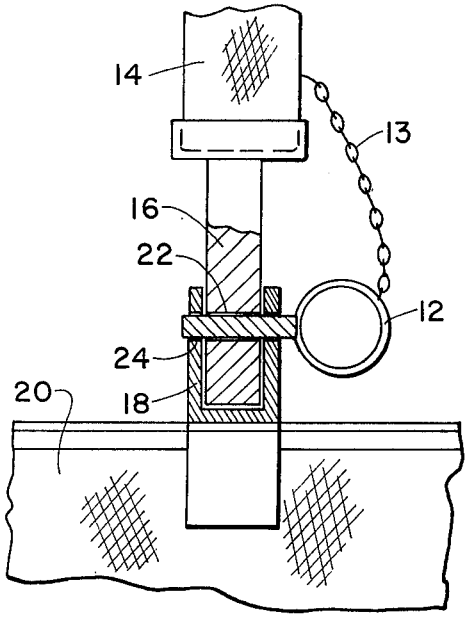
FIG. 3 is a close up view of the assembled quick release in partial cross section.

With regard to FIGS. 2 and 3, we see that the pin 12 is attached by the chain 13 to the strap 14 and that the female ferrule 16 forms a shaftway 22 through which the pin 12 may pass. The female ferrule 18 is seen to be secured to the top of the waders 20 and to form a pair of shaftways 24 through which the pin 12 may pass when the male ferrule 16 is inserted into the female ferrule 18.

The sliding action of the pin through the shaftways 22 and 24 permits easier removal of the pin 12 even when the vertical pressure on the ferrules 16 and 18 is large due to water having entered the waders 20. This is much easier to operate than prior art devices such as snaps which must be operated against the vertical pressures caused by the presence of the water in the waders pulling down on the fisherman.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. A quick release for waders, comprising:

a pair of waders, a strap attached to the waders, means of movably attaching a pin to the strap, a male ferrule forming a shaftway through the ferrule and attached to an end of the strap, and a female ferrule forming a pair of shaftways through the female ferrule and attached to an upper edge of the waders, whereby the male ferrule may be received in the female ferrule and the pin may be passed through the shaftways of the female and the male ferrules thereby releaseably connecting the waders strap to the waders and thereby securing the waders to a fisherman.

2. The quick release of claim 1, wherein the means of connecting the pin to the strap is a chain, the male ferrule is of square section, and the female is a U-shaped section.

3. The quick release of claim 2, wherein the pin releaseably passes through the shaftway in the male and female ferrules which are horizontally aligned.

* * * * *